US006922995B2

(12) United States Patent
Kawamura et al.

(10) Patent No.: US 6,922,995 B2
(45) Date of Patent: Aug. 2, 2005

(54) SUPERCHARGING DEVICE FOR INTERNAL COMBUSTION ENGINE

(75) Inventors: Katsuhiko Kawamura, Yokohama (JP); Kenichi Fujimura, Yokohama (JP); Hideharu Kadooka, Yokohama (JP); Susumu Kubo, Yokohama (JP); Motoyuki Hattori, Yokohama (JP); Naoki Mishima, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 6 days.

(21) Appl. No.: 10/780,750

(22) Filed: Feb. 19, 2004

(65) Prior Publication Data

US 2004/0187852 A1 Sep. 30, 2004

(30) Foreign Application Priority Data

Mar. 27, 2003 (JP) ..... 2003-087972

(51) Int. Cl.[7] ..... F02B 33/44
(52) U.S. Cl. ..... 60/608; 123/561
(58) Field of Search ..... 123/561–565, 123/559.1; 60/608, 605.1, 611

(56) References Cited

U.S. PATENT DOCUMENTS

| | | | | |
|---|---|---|---|---|
| 4,485,310 A | | 11/1984 | de Valroger | |
| 5,117,799 A | * | 6/1992 | Suzuki et al. | 123/561 |
| 5,347,972 A | * | 9/1994 | Sandou et al. | 123/564 |
| 5,394,848 A | | 3/1995 | Tsutsumi et al. | |
| 6,062,026 A | | 5/2000 | Woolenweber et al. | 60/612 |
| 6,622,710 B2 | * | 9/2003 | Hasegawa et al. | 123/563 |
| 6,684,863 B2 | * | 2/2004 | Dixon et al. | 123/565 |

FOREIGN PATENT DOCUMENTS

| | | | | |
|---|---|---|---|---|
| DE | 32 05 722 A1 | | 8/1983 | |
| DE | 19905112 A1 | * | 8/2000 | F02B/37/04 |
| EP | 1355052 A1 | * | 10/2003 | F02B/37/04 |
| EP | 1391595 A1 | * | 2/2004 | F02B/37/04 |
| JP | 2000-204958 A | | 7/2000 | |
| JP | 2001280145 A | * | 10/2001 | F02B/39/04 |
| JP | 2002038961 A | * | 2/2002 | F02B/39/10 |
| JP | 2002-357127 A | | 12/2002 | |
| WO | WO 92/09800 A1 | | 6/1992 | |

* cited by examiner

*Primary Examiner*—Thai-Ba Trieu
(74) *Attorney, Agent, or Firm*—Foley & Lardner LLP

(57) ABSTRACT

In an intake passage (1) of an internal combustion engine (8), a compressor (4) combined with an electric motor/generator **(4*a*) is provided. A bypass valve (6) connecting upstream and downstream portions of the intake passage (1) to bypass the compressor (4) is further provided. When a required intake air flow rate of the engine (8) is smaller than a threshold value, the engine (8) operates by natural aspiration of intake air and the electric motor/generator (4*a*) generate electric power by using rotational energy of the compressor (4) which rotates due to the flow of intake air. By increasing the opening of the bypass valve (6) as the required intake air flow rate diverges from the discharge flow rate of the compressor (4)** the intake air flow rate is accurately controlled while satisfying the power generation requirement.

19 Claims, 5 Drawing Sheets

BYPASS VALVE
OPEN
CLOSE

THROTTLE
OPEN
CLOSE

COMPRESSOR ROTATION SPEED

INTAKE AIR FLOW RATE
Qa
Qs
t0
t1
t2
t3

SUPERCHARGING DEVICE FOR INTERNAL COMBUSTION ENGINE

FIELD OF THE INVENTION

This invention relates to control of a supercharging device which uses an electrical supercharger in order to turbocharge intake air of an internal combustion engine.

BACKGROUND OF THE INVENTION

JP2002-357127A published by the Japan Patent Office in 2002 discloses an electrical supercharging device for supercharging intake air of an internal combustion engine. The device comprises a supercharger disposed in the intake passage of the internal combustion engine and an electric motor driving the supercharger. The supercharger comprises a Root's blower or a displacement compressor.

When the engine is operating at a high load, the supercharger supercharges intake air of the internal combustion engine in response to the operation of the electric motor. When the engine is operating at a low load, the device is adapted to allow natural aspiration of intake air by the engine through the supercharger. Under these conditions, the supercharger is rotated by the flow of intake air. The supercharger thereby performs power generation operations by driving the electric motor as a generator. Generated power is stored in a battery and is used in order to drive the supercharger as well as other uses. In this manner, a portion of the electrical energy used for supercharging is recovered when the engine operates at a low load.

SUMMARY OF THE INVENTION

According to the prior art, the supercharger is rotated by flow energy of intake air aspirated into the engine. The intake air amount of the engine under these conditions varies in response to the rotation resistance of the supercharger. The prior art suppresses the intake air amount of the engine to a target intake air amount by varying the power generation amount of the electric motor. In other words, the prior art uses the supercharger instead of an intake throttle.

This arrangement displays preferred characteristics when the engine is coasting under fixed operating parameters. However when the operating conditions of an engine such as a vehicle engine undergo constant variation, the inertial resistance of the supercharger makes it difficult to control the intake air amount with high response characteristics. Furthermore it is difficult for the prior-art arrangement to achieve the required intake air amount and power generation amount together.

It is therefore an object of this invention to increase the response characteristics for control of the intake air amount of an engine comprising an electric supercharger having a power generation function operated by air flow during natural aspiration.

It is a further object of this invention to achieve a required intake air amount and required power generation amount together in an internal combustion engine provided with such a supercharging device.

In order to achieve the above objects, this invention provides a supercharging device for supercharging intake air in an intake passage of an internal combustion engine based on a required intake air flow rate of the engine.

The device comprises a positive-displacement supercharger disposed in the intake passage, an electric motor driving the supercharger in response to a supplied electric power, a bypass passage bypassing the supercharger and connecting an upstream portion and a downstream portion of the intake passage, a bypass valve which opens and closes the bypass passage, and a programmable controller. The electric motor functions as a generator when a rotational energy is input from the supercharger.

The programmable controller is programmed to calculate a discharge flow rate of the supercharger, and regulate an opening of the bypass valve based on the discharge flow rate of the supercharger and the required intake air flow rate of the engine.

This invention also provides a control method for a supercharging device for supercharging intake air in an intake passage of an internal combustion engine based on a required intake air flow rate of the engine, wherein the device comprises a positive-displacement supercharger disposed in the intake passage, an electric motor driving the supercharger in response to a supplied electric power, a bypass passage bypassing the supercharger and connecting an upstream portion and a downstream portion of the intake passage, and a bypass valve which opens and closes the bypass passage. The electric motor functions as a generator when a rotational energy is input from the supercharger.

The control method comprises determining a discharge flow rate of the supercharger, and regulating an opening of the bypass valve based on the discharge flow rate of the supercharger and the required intake air flow rate of the engine.

The details as well as other features and advantages of this invention are set forth in the remainder of the specification and are shown in the accompanying drawings.

DESCRIPTION OF THE PREFERRED EMBODIMENTS

Figure 1:
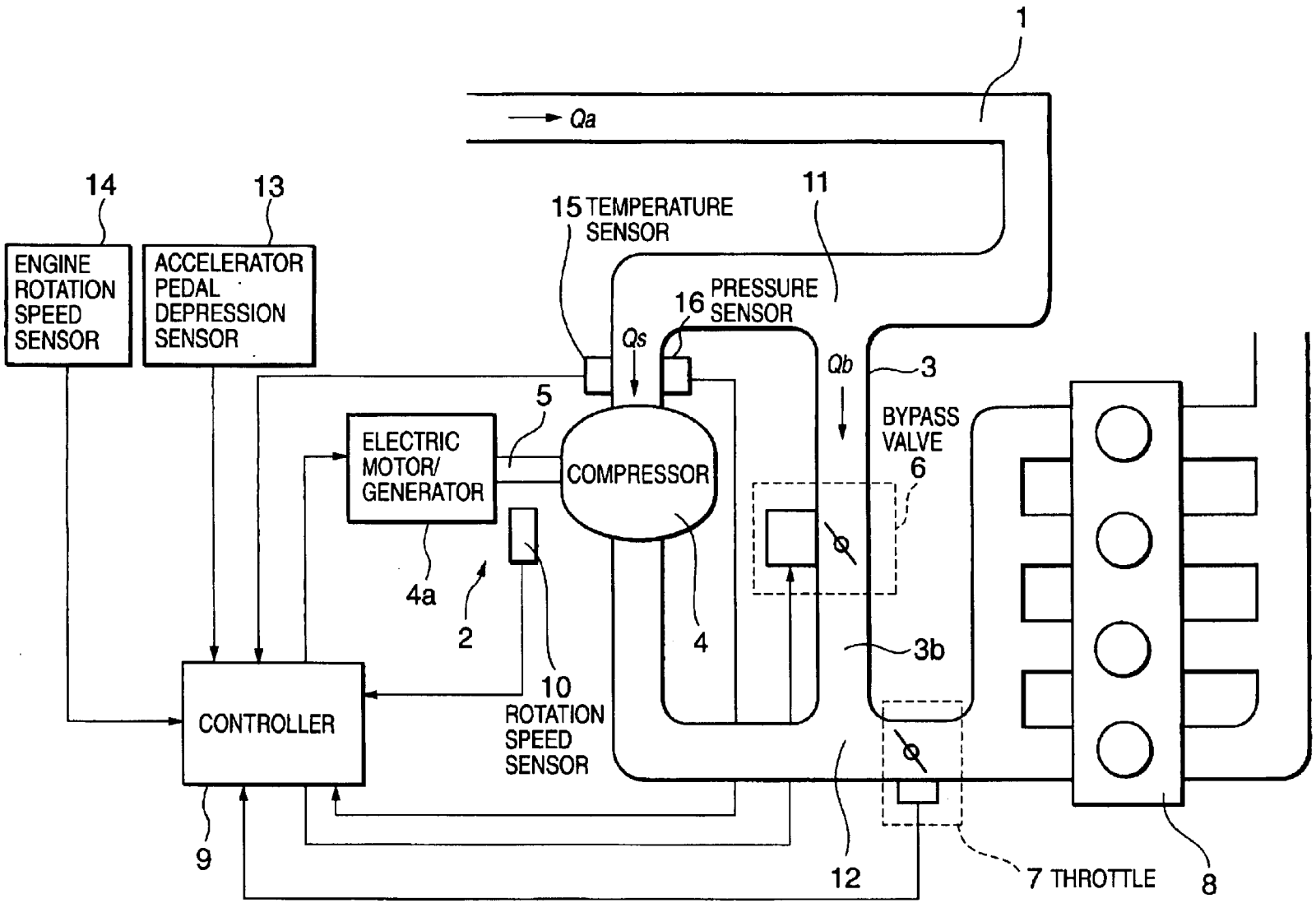
FIG. 1 is a schematic diagram of a supercharging device according to this invention.

Referring to FIG. 1 of the drawings, an internal combustion engine 8 for a vehicle to which a supercharging device according to this invention is applied aspirates air from an air intake passage 1.

The supercharging device comprises an electric supercharging unit 2 which supercharges intake air in the intake passage 1. The electric supercharging unit 2 comprises a positive-displacement compressor 4 disposed in the intake passage 1, an electric motor/generator 4*a* and a rotation shaft 5 connecting the electric motor 4*a* and the compressor 4. A Root's blower may be used instead of the positive-displacement compressor 4. The compressor 4 and the Root's blower correspond to the positive-displacement supercharger in the claims. The motor/generator 4*a* is constituted by an alternating-current generator known as an alternator.

The electric motor/generator 4*a* is provided with an inverter for controlling operation in response to an input signal. The supercharging device further comprises an intake throttle 7 provided in the intake passage 1 between the compressor 4 and the engine 8. The supercharging device further comprises a bypass passage 3 having a bypass valve 6 through which intake air in the intake passage 1 is lead to the intake throttle 7 without passing through the compressor 4.

A controller 9 outputs signals in order to control the operation of the electric motor/generator 4*a*, the opening of the bypass valve 6 and the opening of the intake throttle 7.

The controller 9 comprises a microcomputer provided with a central processing unit (CPU), a read-only memory (ROM), a random access memory (RAM) and an input/output interface (I/O interface). The controller 9 may comprise a plurality of microcomputers.

In order to realize the above control, signals are input to the controller 9 from a rotation speed sensor 10 detecting a rotation speed of the rotation shaft 5, an accelerator pedal depression sensor 13 detecting a depression amount of an accelerator pedal provided in the vehicle, an engine rotation speed sensor 14 detecting an engine rotation speed, a temperature sensor 15 detecting a temperature in the intake passage 1 upstream of the compressor 4 and a pressure sensor 16 detecting a pressure in the intake passage 1 upstream of the compressor 1.

Since the rotation speed of the rotation shaft 5 is equal to the rotation speed of the compressor 4, the rotation speed sensor 10 functions as a sensor detecting the rotation speed of the compressor 4.

The controller 9 calculates a required intake air flow rate Qa for the engine 8 based on the above signals including the depression amount of the acceleration pedal. When the required intake air flow rate Qa is greater than a predetermined threshold value, the controller 9 drives the compressor 4 by operating the electric motor/generator 4*a* as an electric motor in order to supercharge intake air of the engine 8. Under these conditions, the controller 9 places the intake air throttle 7 in a fully-open position, places the bypass valve 6 in a fully closed position and supplies power to the electric motor/generator 4*a* from a battery stored in the vehicle.

When the required intake air flow rate Qa is not greater than the predetermined threshold value, the controller 9 does not supply battery power to the electric motor/generator 4*a* so as not to supercharge the intake air, while allowing air flow in the compressor 4 due to natural aspiration of intake air by the engine 8.

When a negative intake pressure is produced in the intake passage 1 due to the intake stroke of the engine 8, air flows from the outside atmosphere into the engine 8 through the intake passage 1. Consequently the compressor 4 is rotated by the flow of intake air. The resulting rotational torque is transmitted to the electric motor/generator 4*a* through the rotation shaft 5. Electrical power is thereby generated in the electric motor/generator 4*a* and is stored in the battery. The controller 9 controls openings of the bypass valve 6 and the intake air throttle 7, and the power generation amount of the electric motor/generator 4*a* in order to realize the required intake air flow rate Qa, while maintaining a desired power generation amount.

Figure 2:
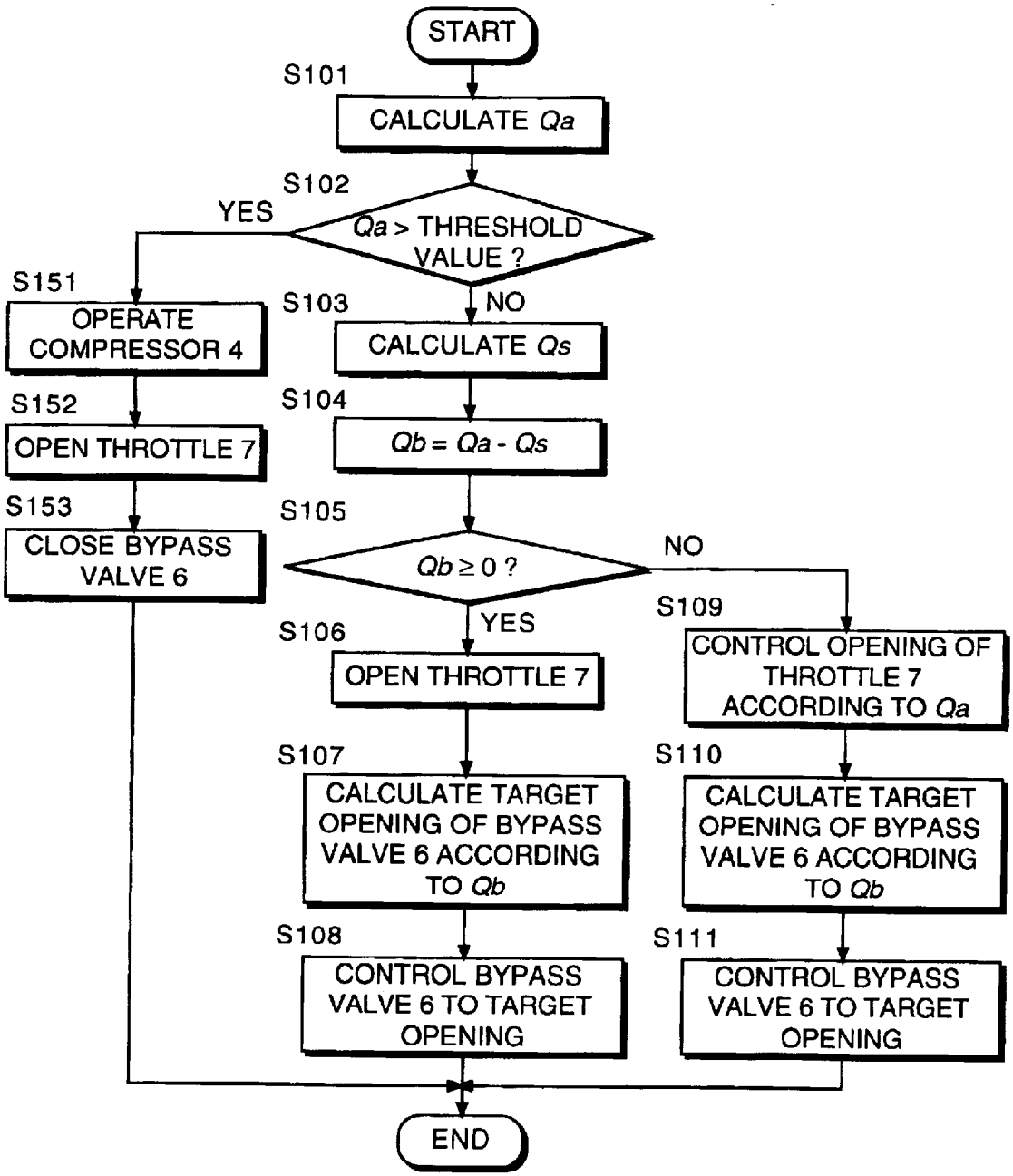
FIG. 2 is a flowchart showing a routine for controlling an electric motor/generator, a bypass valve and a throttle executed by a controller according to this invention.

Referring to FIG. 2, a routine for controlling the throttle 7, the bypass valve 6 and the electric motor/generator 4*a* which is executed by the controller 9 in order to realize the above control will be described. This routine is executed at an interval of ten milliseconds while the engine 8 is operating.

Firstly in a step S101, the controller 9 calculates the required intake air flow rate Qa for the engine 8 based on the engine rotation speed detected by the engine rotation speed sensor 14 and the accelerator pedal depression amount detected by the accelerator pedal depression sensor 13.

Then in a step S102, the controller 9 determines whether or not a supercharging operation is required by comparing the required intake air flow rate Qa with the predetermined threshold value.

When the required intake air flow rate Qa is greater than the threshold value, the controller 9 determines that supercharging operation is required and executes the process in steps S151–S153.

In the step S151, the compressor 4 is operated by supplying power to the electric motor 4*a*. Then in the step S152, the throttle 7 is fully opened. In the next step S153, the bypass valve 153 is fully closed. As a result of this process, intake air corresponding to the required intake air flow rate Qa is supercharged by the compressor 4. After the process in the step S153, the controller 9 terminates the routine.

In contrast, when the required intake air flow rate Qa is not greater than the threshold value in the step S102, the controller 9 determines than supercharging is not required.

In this case, the controller 9 calculates the discharge flow rate Qs of the compressor 4 in a step S103 based on the pressure in the intake passage 1 upstream of the compressor 4 detected by the pressure sensor 16, the temperature of the intake passage 1 upstream of the compressor 4 detected by the temperature sensor 15 and the rotation speed of the rotation shaft 5 detected by the rotation speed sensor 10. The calculated discharge flow rate Qs is a mass flow rate. The positive-displacement compressor 4 discharges a fixed amount of air on each rotation. Thus the relationship between the rotation speed of the compressor 4 and the discharge flow rate Qs can be expressed by the formula below.

Qs=(coefficient)·(pressure of intake passage 1 upstream of the compressor 4)·(rotation speed of the compressor 4)/(temperature of the intake passage 1 upstream of the compressor 4)

The controller 9 calculates the difference Qb between the discharge Qs of the compressor 4 and the required intake air flow rate Qa in a next 4 using the following formula.

$$Qb=Qa-Qs$$

In a next step S105, the controller 9 determines whether or not the difference Qb is greater than or equal to zero. When Qb is greater than or equal to zero, in other words, when the required intake air flow rate Qa is greater than or equal to the discharge flow rate Qs of the compressor 4, in a step S106, the controller 9 sets the throttle 7 to be fully open or to an opening which is greater than an opening which corresponds to the required intake air rate Qa.

Figure 3:
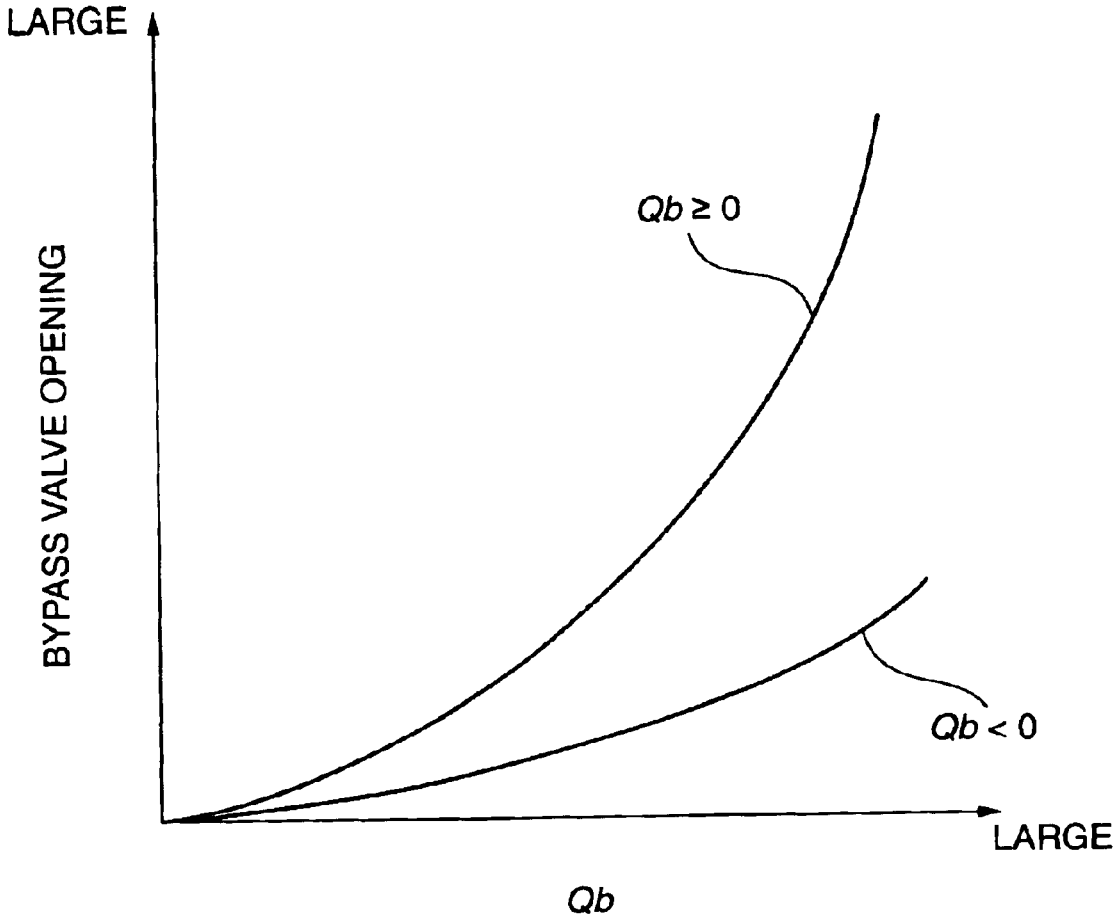
FIG. 3 is a diagram showing the characteristics of a map of an opening of the bypass valve stored in the controller.

In a next step S107, the controller uses the difference Qb to look up a map having characteristics shown on a curve corresponding to $Qb \geqq 0$ in FIG. 3 and calculates a target opening of the bypass valve 6. The map is stored beforehand in the memory (ROM) of the controller 9. The map shows that as the difference Qb increases, in other words, as the required intake air flow rate Qa takes larger values than the discharge flow rate Qs of the compressor 4, the target opening of the bypass valve 6 is increased.

Then in a step S108, the controller 9 controls the opening of the bypass valve 6 to the target opening set in the step S107. After the process in the step S108, the controller terminates the routine.

As shown above, when the required intake air flow rate Qa is greater than or equal to the discharge flow rate Qs of the compressor 4, the control of the intake air flow rate in the steps S106–S108 is controlled by the bypass valve 6 and not the throttle 7.

In the step S105, when the required intake air flow rate Qa is less than the discharge flow rate Qs of the compressor 4, the controller 9 performs the process in steps S109–S111. The case where the intake air flow rate Qs is less than the discharge flow rate Qs occurs when the engine load undergoes a temporary fluctuation.

In a step S109, the controller 9 controls the opening of the throttle 7 to an opening which corresponds to the required intake air flow rate Qa.

Then in a step S110, the controller 9 calculates the target opening of the bypass valve 6 by looking up a map having characteristics shown on a curve corresponding to Qb<0 as shown in FIG. 3. This map is prestored in the memory (ROM) of the controller 9. This map shows that as a negative value for Qb increases, in other words, as the discharge flow rate Qs of the compressor 4 takes larger values than the required intake air flow rate Qa, the opening of the bypass valve 6 is increased.

In a next step S111, the controller 9 controls the opening of the bypass valve 6 to the target opening set in the step S110. After the process in the step S111, the controller 9 terminates the routine.

To summarize this process with respect to the control of the opening of the bypass valve 6, when the difference Qb of the required intake air flow rate Qa and the discharge flow rate Qs of the compressor 4 is zero, the bypass valve 6 is fully closed. As the difference Qb of the required intake air flow rate Qa and the discharge flow rate Qs of the compressor 4 increases, the opening of the bypass valve 6 is increased. However when the required intake air flow rate Qa exceeds the discharge flow rate Qs of the compressor 4, in other words, during supercharging operations when the intake air flow rate Qa is greater than the discharge flow rate Qs of the compressor 4, the opening of the bypass valve 6 is greater than the opening of the bypass valve 6 during natural aspiration with respect to the same absolute value |Qb|.

Referring to FIGS. 4A–4D, variation in the rotation speed of the compressor 4, the opening of the throttle 7 and the opening of the bypass valve 6 relative to variation in the intake air flow rate of the engine 8 according to the execution of this control routine will be described.

Herein the required intake air flow rate Qa of the engine 8 is fixed. The rotation speed of the compressor 4 is controlled through the inverter in response to the required power generation amount. For example, even when the negative intake pressure of the engine 8 is constant, the power generation load on the electric motor/generator 4*a* increases when the required power generation amount is large.

As a result, the rotation resistance of the electric motor/generator 4*a* becomes large which causes the rotation speed of the compressor 4 to decrease. On the other hand, when the required power generation amount is small, the rotation resistance of the electric motor/generator 4*a* is also small and, as a result, the rotation speed of the compressor 4 increases. This is due to the fact that the power generation load on the electric motor/generator 4*a* is small.

Figures 4A, 4B, 4C, 4D:
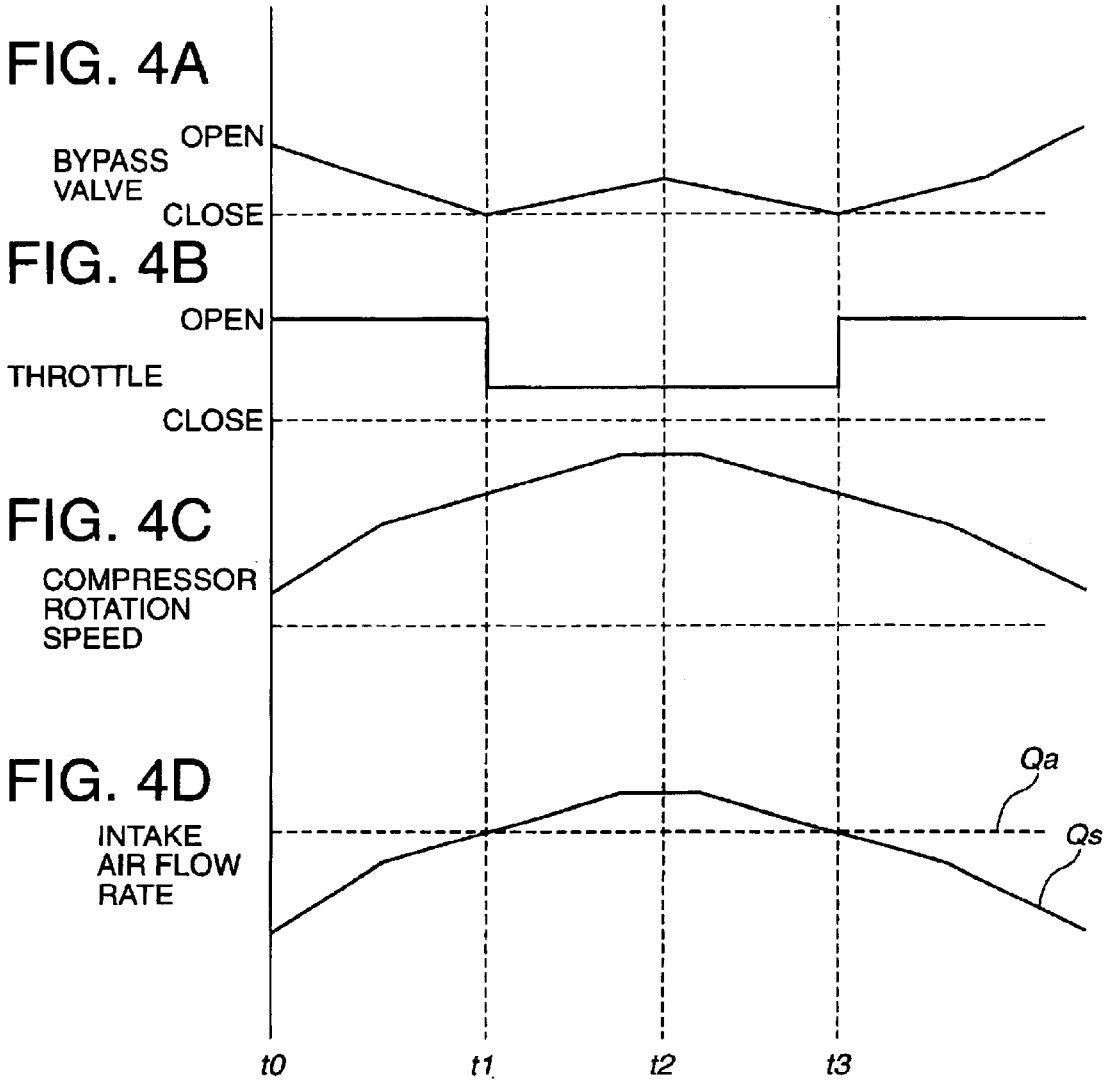
FIGS. 4A–4D is a timing chart showing a result of control of the bypass valve and the throttle executed by the controller.

At a time t0, the rotation speed of the compressor 4 shown in FIG. 4C is small and the discharge flow rate Qs of the compressor 4 is smaller than the required intake air flow rate Qa of the engine 8. Under these conditions, in the step S109, the throttle 7 is fully open or is maintained at an opening which is greater than the opening corresponding to the required intake air flow rate Qa. The shortfall in air, if any, is supplied through the bypass passage 3.

In the step S107, the target opening of the bypass valve 6 at this time is determined by looking up a map having characteristics showing the curve corresponding to Qb≧0 in FIG. 3. The target opening is looked up based on the difference Qb of the discharge flow rate Qs of the compressor 4 and the required intake air flow rate Qa.

In the interval from the time t0 and t1 where the condition Qb≧0 is established, the process in the steps S106–S108 is repeated. The opening of the bypass valve 6 is gradually decreased in response to increases in the rotation speed of the compressor 4.

At the time t1, at the same time as the discharge air flow rate Qs becomes equal to the required intake air flow rate Qa of the engine 9, in other words, at the same time as Qb takes a value of zero, the opening of the bypass valve 6 becomes zero.

In the interval t1 to t2, since the discharge flow rate Qs of the compressor 4 is greater than the required intake air flow rate Qa of the engine 8, the process in the steps S109–S111 is repeated. In other words, the opening of the throttle 7 in the step S109 is regulated to an opening which corresponds to the required intake air flow rate Qa.

In the step S110, the target opening of the bypass valve 6 is determined by looking up the map having characteristics shown by the curve corresponding to Qb<0 in FIG. 3. The opening is determined in response to the difference Qb of the required intake air flow rate Qa and the discharge flow rate Qs of the compressor 4. In the step S111, the opening of the bypass valve 6 is regulated to the target opening. The opening of the bypass valve 6 increases as the absolute valve in the difference Qb increases.

In proximity to the time t2, the rotation speed of the compressor 4 shifts to decrease from increasing. As a result, the opening of the bypass valve 6 decreases as the difference between the required intake air flow rate Qa and the discharge flow rate Qs of the compressor decreases.

At a time t3, the discharge flow rate Qs of the compressor 4 equals again the required intake air flow rate Qa of the engine 8. At this point, the bypass valve 6 is completely closed.

After the time t3, the required intake air flow rate Qa exceeds the discharge flow amount Qs of the compressor 4. The throttle 7 is once again opened fully or to a larger opening than the opening corresponding to the required intake air flow rate Qa. Since the difference Qb once again increases under the condition Qb≧0, the bypass valve 6 which had been completely closed is once again opened. The opening increases as time elapses.

Figure 5:
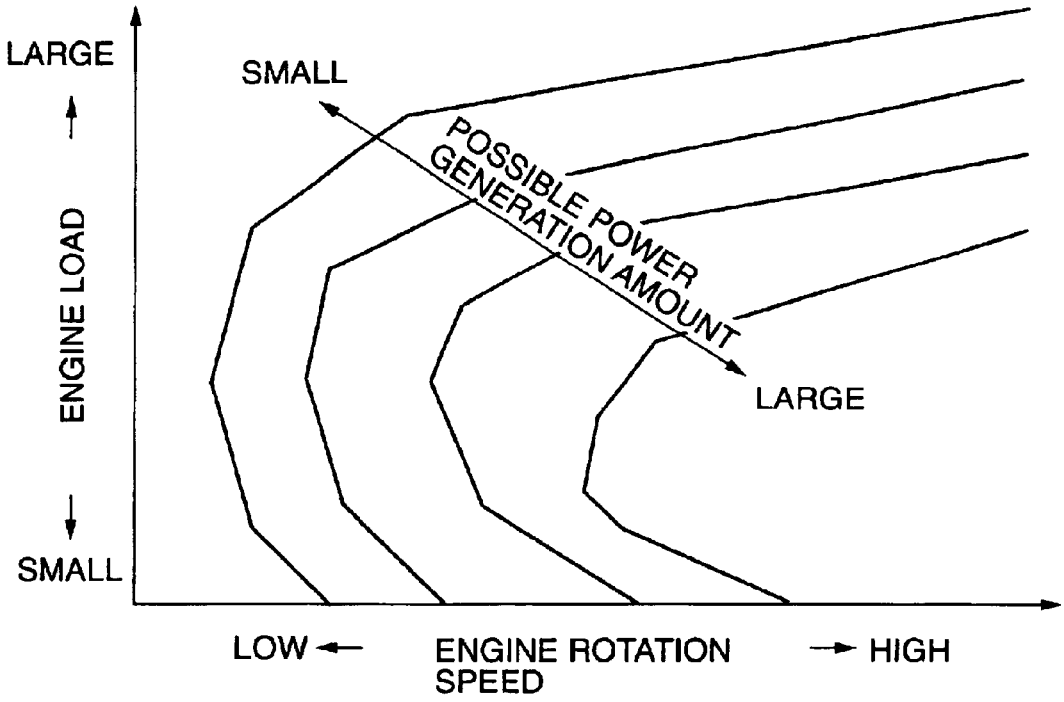
FIG. 5 is a diagram showing the characteristics of a map of potential power generation amount of the electric motor/generator stored in the controller.

Next, referring to FIG. 5, the energy recovered by the electric motor/generator 4*a* will be described.

This figure shows the power generation characteristics of the electric motor/generator 4*a*. According to this figure, at an engine load which is greater than or equal to a fixed value, the power generation potential of the electric motor/generator 4*a* increases as the rotation speed of the engine 8 increases or as the load on the engine 8 decreases.

When the load on the engine 8 is low, the prior art device regulates the intake air flow rate by decreasing the opening of the throttle. However when the opening of the throttle decreases, the pressure in a space between the throttle and the engine decreases and results in pumping loss. According to the supercharging device described above, as long as the required intake air flow rate Qa is greater than the discharge flow amount Qs of the compressor 4, the throttle 7 is fully open or maintained at an opening which is greater than or equal to the opening corresponding to the required intake air flow rate Qa.

According to this control, the pumping loss due to decrease in the throttle opening will not occur. In other words, the energy that was lost in the prior art device can be recovered according to this supercharging device.

Further, in this supercharging device, the electric motor/generator 4*a* is normally capable of generating power except for the case where supercharging is required, so a high energy recovery efficiency is achieved.

On the other hand, irrespective of supercharging operations, when the discharge flow rate Qs of the compressor 4 diverges from the required intake air flow rate Qa, the bypass valve 6 is operated to compensate the difference such that the required intake air flow rate Qa is achieved.

Thus according to this supercharging device, it is possible to realize both the required power generation amount and the required intake air flow rate at the same time as well as to increase the response characteristics of control of the intake air flow rate.

The contents of Tokugan 2003-087972, with a filing date of Mar. 27, 2003 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, in this embodiment, the discharge flow rate Qs of the compressor 4 is calculated based on the rotation speed of the compressor 4 and the pressure and temperature of the intake passage 1. Thus it is possible to detect the discharge flow rate of the compressor 4 without increasing the resistance to the flow of intake air. However of course it is possible to detect the discharge flow rate of the compressor 4 by providing an air flow meter in the discharge port of the compressor 4.

It is also possible to vary the intake air flow rate of the engine 8 without using the throttle 7, by varying the lift amount of an intake air valve of the engine 8, for example.

The embodiments of this invention in which an exclusive property or privilege is claimed are defined as follows:

1. A control method for a supercharging device for supercharging intake air in an intake passage of an internal combustion engine based on a required intake air flow rate of the engine, the device comprising a positive-displacement supercharger disposed in the intake passage, an electric motor driving the supercharger in response to a supplied electric power, the electric motor functioning as a generator when a rotational energy is input from the supercharger, a bypass passage bypassing the supercharger and connecting an upstream portion and a downstream portion of the intake passage, and a bypass valve which opens and closes the bypass passage, the method comprising:

determining a discharge flow rate of the supercharger;

regulating an opening of the bypass valve based on the discharge flow rate of the supercharger and the required intake air flow rate of the engine;

driving the supercharger by supplying electric power to the electric motor to supercharge intake air in the intake passage when the required intake air flow rate of the engine is greater than a predetermined threshold value; and causing the electric motor/generator to generate electric power by a rotational energy input from the supercharger which rotates according to an air flow in the intake passage when the required intake air flow rate of the engine is not greater than the threshold value.

2. A supercharging device for supercharging intake air in an intake passage of an internal combustion engine based on a required intake air flow rate of the engine, the device comprising:

a positive-displacement supercharger disposed in the intake passage;

an electric motor driving the supercharger in response to a supplied electric power, the electric motor functioning as a generator when a rotational energy is input from the supercharger;

a bypass passage bypassing the supercharger and connecting an upstream portion and a downstream portion of the intake passage;

a bypass valve which opens and closes the bypass passage;

means for determining a discharge flow rate of the supercharger;

means for regulating an opening of the bypass valve based on the discharge flow rate of the supercharger and the required intake air flow rate of the engine;

means for driving the supercharger by supplying electric power to the electric motor to supercharge intake air in the intake passage when the required intake air flow rate of the engine is greater than a predetermined threshold value; and means for causing the electric motor/generator to generate electric power by a rotational energy input from the supercharger which rotates according to an air flow in the intake passage when the required intake air flow rate of the engine is not greater than the threshold value.

3. The supercharging device as defined in claim 2, further comprising a means for closing the bypass valve when the required intake air flow rate of the engine is greater than the threshold value.

4. The supercharging device as defined in claim 2, further comprising a means for increasing the opening of the bypass valve as a difference between the discharge flow rate of the supercharger and the required intake air flow rate of the engine increases, when the required intake air flow rate of the engine is not greater than the threshold value.

5. The supercharging device as defined in claim 2, further comprising a means for opening the bypass valve to a larger degree in a case where the required intake air flow rate of the engine is not greater than the discharge flow rate of the supercharger than in a case where the required intake air flow rate of the engine is greater than the discharge flow rate of the supercharger.

6. The supercharging device as defined in claim 2, wherein the device further comprises a throttle provided in the intake passage downstream of the supercharger, and wherein the bypass passage is configured to branch off from the intake passage upstream of the supercharger and join the intake passage upstream of the throttle.

7. The supercharging device as defined in claim 6, further comprising a means for opening the throttle larger than an opening corresponding to the required intake air flow rate of the engine when the required intake air flow rate of the engine is not smaller than the discharge flow rate of the supercharger.

8. The supercharging device as defined in claim 6, further comprising a means for controlling the throttle to an opening corresponding to the required intake air flow rate of the engine when the required intake air flow rate of the engine is smaller than the discharge flow rate of the supercharger.

9. The supercharging device as defined in claim 2, wherein the device is adapted for use with an engine for a vehicle having an accelerator pedal, wherein the device further comprises a sensor which detects a depression amount of the accelerator pedal, and wherein the device is adapted to calculate the required intake air flow rate of the engine based on the depression amount of the acceleration pedal.

10. A supercharging device for supercharging intake air in an intake passage of an internal combustion engine based on a required intake air flow rate of the engine, the device comprising:

a positive-displacement supercharger disposed in the intake passage;

an electric motor driving the supercharger in response to a supplied electric power, the electric motor functioning as a generator when a rotational energy is input from the supercharger;

a bypass passage bypassing the supercharger and connecting an upstream portion and a downstream portion of the intake passage;

a bypass valve which opens and closes the bypass passage; and a programmable controller programmed to:

calculate a discharge flow rate of the supercharger; and regulate an opening of the bypass valve based on the discharge flow rate of the supercharger and the required intake air flow rate of the engine; wherein the device further comprises a sensor which detects a rotation speed of the supercharger, a sensor which detects a pressure of the intake passage upstream of the supercharger and a sensor which detects a temperature of the intake passage upstream of the supercharger, and wherein the controller is further programmed to calculate the discharge flow rate of the supercharger based on the temperature and the pressure of the intake passage upstream of the supercharger and the rotation speed of the supercharger.

11. A supercharging device for supercharging intake air in an intake passage of an internal combustion engine based on a required intake air flow rate of the engine, the device comprising:

a positive-displacement supercharger disposed in the intake passage;

an electric motor driving the supercharger in response to a supplied electric power, the electric motor functioning as a generator when a rotational energy is input from the supercharger;

a bypass passage bypassing the supercharger and connecting an upstream portion and a downstream portion of the intake passage;

a bypass valve which opens and closes the bypass passage; and a programmable controller programmed to:

calculate a discharge flow rate of the supercharger;

regulate an opening of the bypass valve based on the discharge flow rate of the supercharger and the required intake air flow rate of the engine;

drive the supercharger by supplying electric power to the electric motor to supercharge intake air in the intake passage when the required intake air flow rate of the engine is greater than a predetermined threshold value; and cause the electric motor/generator to generate electric power by a rotational energy input from the supercharger which rotates according to an air flow in the intake passage when the required intake air flow rate of the engine is not greater than the threshold value.

12. The supercharging device as defined in claim 11, wherein the controller is further programmed to close the bypass valve when the required intake air flow rate of the engine is greater than the threshold value.

13. The supercharging device as defined in claim 11, wherein the controller is further programmed to increase the opening of the bypass valve as a difference between the discharge flow rate of the supercharger and the required intake air flow rate of the engine increases, when the required intake air flow rate of the engine is not greater than the threshold value.

14. The supercharging device as defined in claim 11, wherein the controller is further programmed to open the bypass valve to a larger degree in a case where the required intake air flow rate of the engine is not greater than the discharge flow rate of the supercharger than in a case where the required intake air flow rate of the engine is greater than the discharge flow rate of the supercharger.

15. The supercharging device as defined in claim 11, wherein the device further comprises a throttle provided in the intake passage downstream of the supercharger, and wherein the bypass passage is configured to branch off from the intake passage upstream of the supercharger and join the intake passage upstream of the throttle.

16. The supercharging device as defined in claim 15, wherein the controller is further programmed to open the throttle larger than an opening corresponding to the required intake air flow rate of the engine when the required intake air flow rate of the engine is not smaller than the discharge flow rate of the supercharger.

17. The supercharging device as defined in claim 15, wherein the controller is further programmed to control the throttle to an opening corresponding to the required intake air flow rate of the engine when the required intake air flow rate of the engine is smaller than the discharge flow rate of the supercharger.

18. The supercharging device as defined in claim 11, wherein the device is adapted for use with an engine for a vehicle having an accelerator pedal, wherein the device further comprises a sensor which detects a depression amount of the accelerator pedal, and wherein the controller is further programmed to calculate the required intake air flow rate of the engine based on the depression amount of the acceleration pedal.

19. The supercharging device as defined in claim 1, wherein the device further comprises a sensor which detects a rotation speed of the supercharger, a sensor which detects a pressure of the intake passage upstream of the supercharger and a sensor which detects a temperature of the intake passage upstream of the supercharger, and wherein the controller is further programmed to calculate the discharge flow rate of the supercharger based on the temperature and the pressure of the intake passage upstream of the supercharger and the rotation speed of the supercharger.

* * * * *